US005693904A

United States Patent [19]

Kihneman et al.

[11] Patent Number: 5,693,904

[45] Date of Patent: Dec. 2, 1997

[54] GUITAR PICKUP SIGNAL GENERATOR

[76] Inventors: Rick D. Kihneman, 11055 Harding St., Bay St. Louis, Miss. 39520; Stephen M. Planchard, 125 Boisdore Ave., Pass Christian, Miss. 39571

[21] Appl. No.: 335,068

[22] Filed: Nov. 7, 1994

[51] Int. Cl.[6] ..... G10H 3/00; G10H 3/12

[52] U.S. Cl. ..... 84/725; 84/726; 84/727

[58] Field of Search ..... 84/725–728

[56] References Cited

U.S. PATENT DOCUMENTS 4,064,781 12/1977 Fals ..... 84/322

4,075,921 2/1978 Heet ..... 84/738

4,365,537 12/1982 Pogoda ..... 84/454

5,231,238 7/1993 Adams ..... 84/329

5,449,858 9/1995 Menning et al. ..... 84/727

*Primary Examiner*—William M. Shoop, Jr.

*Assistant Examiner*—Marlon T. Fletcher

[57] ABSTRACT

A device for generating a modulated electromagnetic signal for reception by an electromagnetic pickup of a guitar. The inventive device includes a mounting assembly securable to a guitar pick. Electrical circuitry including a coil is contained within the mounting assembly for generating an electromagnetic signal receivable by the pickup of the guitar.

7 Claims, 3 Drawing Sheets

GUITAR PICKUP SIGNAL GENERATOR

BACKGROUND OF THE INVENTION

1. Field of the Invention

The present invention relates to electric guitar devices and more particularly pertains to a guitar pickup signal generator for generating a modulated electromagnetic signal for reception by an electromagnetic pickup of a guitar.

2. Description of the Prior Art

The use of electric guitar devices is known in the prior art. More specifically, electric guitar devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art electric guitar devices include U.S. Pat. No. 5,300,730; U.S. Pat. No. 5,237,126; U.S. Pat. No. 3,600,497; U.S. Design Pat. No. 330,905; U.S. Design Pat. No. 309,674.

While these devices fulfill their respective, particular objectives and requirements, the aforementioned patents do not disclose a guitar pickup signal generator for generating a modulated electromagnetic signal which includes a mounting assembly securable to a guitar pick, and electrical circuitry including a coil contained within the mounting assembly for generating an electromagnetic signal receivable by a pickup of a guitar.

In these respects, the guitar pickup signal generator according to the present invention substantially departs from the conventional concepts and designs of the prior art, and in so doing provides an apparatus primarily developed for the purpose of generating a modulated electromagnetic signal for reception by an electromagnetic pickup of a guitar.

SUMMARY OF THE INVENTION

In view of the foregoing disadvantages inherent in the known types of electric guitar devices now present in the prior art, the present invention provides a new guitar pickup signal generator construction wherein the same can be utilized for generating a modulated electromagnetic signal. As such, the general purpose of the present invention, which will be described subsequently in greater detail, is to provide a new guitar pickup signal generator apparatus and method which has many of the advantages of the electric guitar devices mentioned heretofore and many novel features that result in a guitar pickup signal generator which is not anticipated, rendered obvious, suggested, or even implied by any of the prior art electric guitar devices, either alone or in any combination thereof.

To attain this, the present invention generally comprises a device for generating a modulated electromagnetic signal for reception by an electromagnetic pickup of a guitar. The inventive device includes a mounting assembly securable to a guitar pick. Electrical circuitry including a coil is contained within the mounting assembly for generating an electromagnetic signal receivable by the pickup of the guitar.

There has thus been outlined, rather broadly, the more important features of the invention in order that the detailed description thereof that follows may be better understood, and in order that the present contribution to the art may be better appreciated.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new guitar pickup signal generator apparatus and method which has many of the advantages of the electric guitar devices mentioned heretofore and many novel features that result in a guitar pickup signal generator which is not anticipated, rendered obvious, suggested, or even implied by any of the prior art electric guitar devices, either alone or in any combination thereof.

It is another object of the present invention to provide a new guitar pickup signal generator which may be easily and efficiently manufactured and marketed.

It is a further object of the present invention to provide a new guitar pickup signal generator which is of a durable and reliable construction.

An even further object of the present invention is to provide a new guitar pickup signal generator which is susceptible of a low cost of manufacture with regard to both materials and labor, and which accordingly is then susceptible of low prices of sale to the consuming public, thereby making such guitar pickup signal generators economically available to the buying public.

Still yet another object of the present invention is to provide a new guitar pickup signal generator which provides in the apparatuses and methods of the prior art some of the advantages thereof, while simultaneously overcoming some of the disadvantages normally associated therewith.

Still another object of the present invention is to provide a new guitar pickup signal generator for generating a modulated electromagnetic signal for reception by an electromagnetic pickup of a guitar.

Yet another object of the present invention is to provide a new guitar pickup signal generator which includes a mounting assembly securable to a guitar pick, and electrical circuitry including a coil contained within the mounting assembly for generating an electromagnetic signal receivable by a pickup of a guitar.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
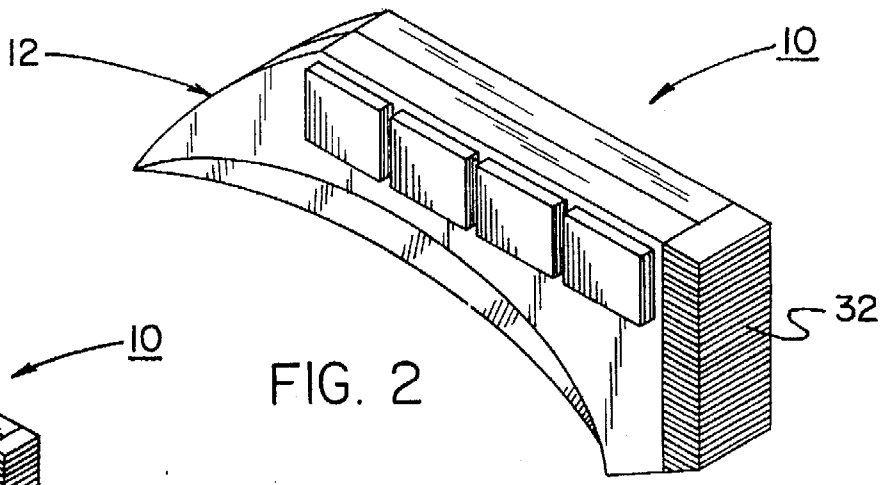
FIG. 2 is an isometric illustration of the invention, per se.

With reference now to the drawings, and in particular to FIGS. 1–7 thereof, a new guitar pickup signal generator embodying the principles and concepts of the present invention and generally designated by the reference numeral 10 will be described.

Figure 1:
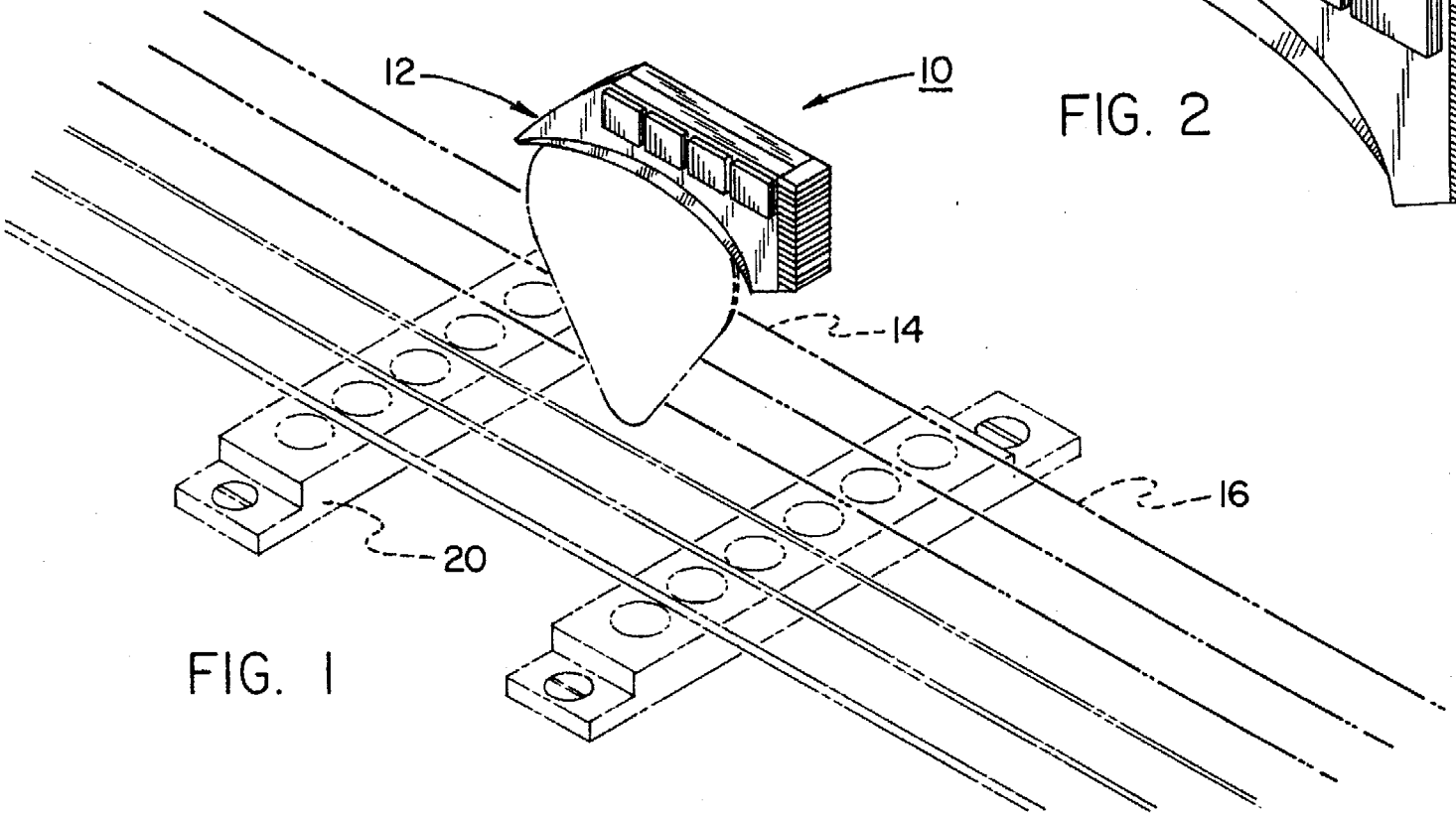
FIG. 1 is an isometric illustration of a guitar pickup signal generator according to the present invention in use.
Figure 3:
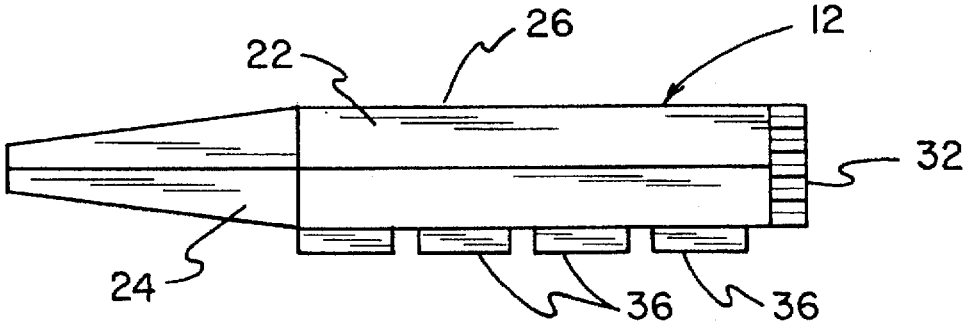
FIG. 3 is a top plan view thereof.

More specifically, it will be noted that the guitar pickup signal generator 10 comprises a mounting means 12 for securing to a pick 14 commonly utilized to pluck the strings 16 of a conventional, and only partially illustrated, electric guitar, as shown in FIG. 1. Electromagnetic signal generating means 18, as shown in FIG. 7, is contained within the mounting means 12 and operable for generating an electromagnetic signal for reception by an electromagnetic pickup 20 of the electric guitar.

Figure 4:
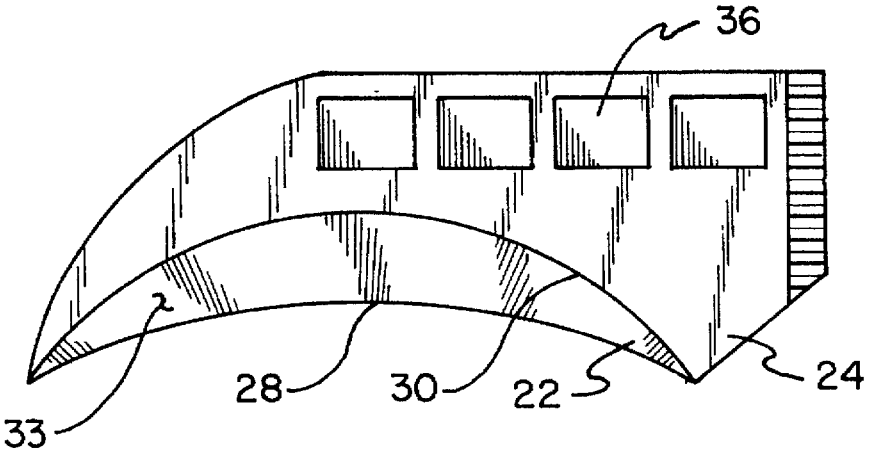
FIG. 4 is a front elevation view of the device.
Figure 5:
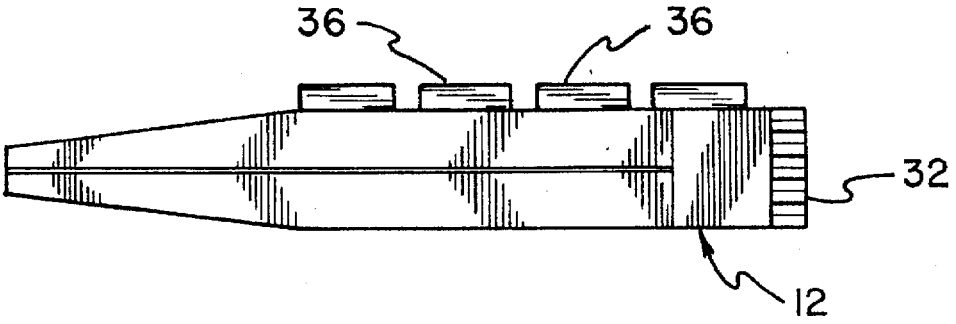
FIG. 5 is a bottom plan view of the invention.
Figure 6:
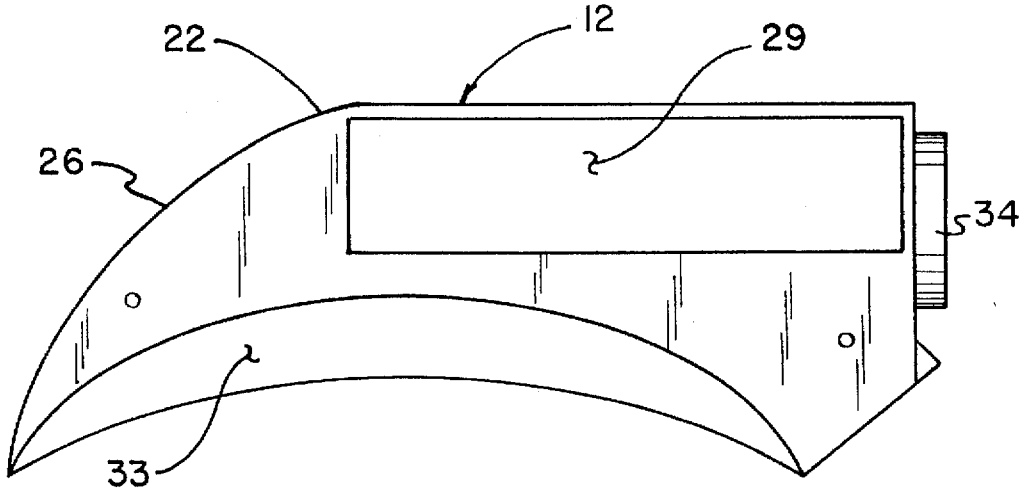
FIG. 6 is a front elevation view of a first housing portion comprising a part of the mounting means of the invention.

As best illustrated in FIGS. 2 through 6, it can be shown that the mounting means 12 according to the present invention 10 preferably comprises a first housing portion 22 secured to a cooperatively constructed second housing portion 24 to define a housing 26 couplable to the pick 14 and operable to contain the electromagnetic signal generating means 18 within an interior compartment 29 thereof, as shown in FIG. 6. To this end and as illustrated in FIG. 4, the first housing portion 22 is shaped so as to define a first arcuate contour 28 characterized by a first radius of curvature, with the second housing portion 24 being shaped so as to define a second arcuate contour 30 characterized as having a second radius of curvature. Preferably, the first radius of curvature of the first arcuate contour 28 is substantially greater than the second radius of curvature of the second arcuate contour 30 so as to define a pick recess 33 within which a portion of the pick 14 can be positioned and secured thereto through the use of a conventionally known adhesive or mechanical fastening means. Alternatively, the pick 14 may simply be received between the first and second housing portions 22 and 24 and mechanically secured thereto by suitable adhesives or mechanical fasteners which effectively clamp the pick therebetween. The housing 26 includes an access door 32 removably mounted thereto providing access to a battery 34 positioned therebeneath, as shown in FIG. 6 wherein the access door 32 is removed. By this structure, a pick 14 can be secured to the mounting means 12 to provide support for the electromagnetic signal generating means 18 relative to the pick.

Figure 7:
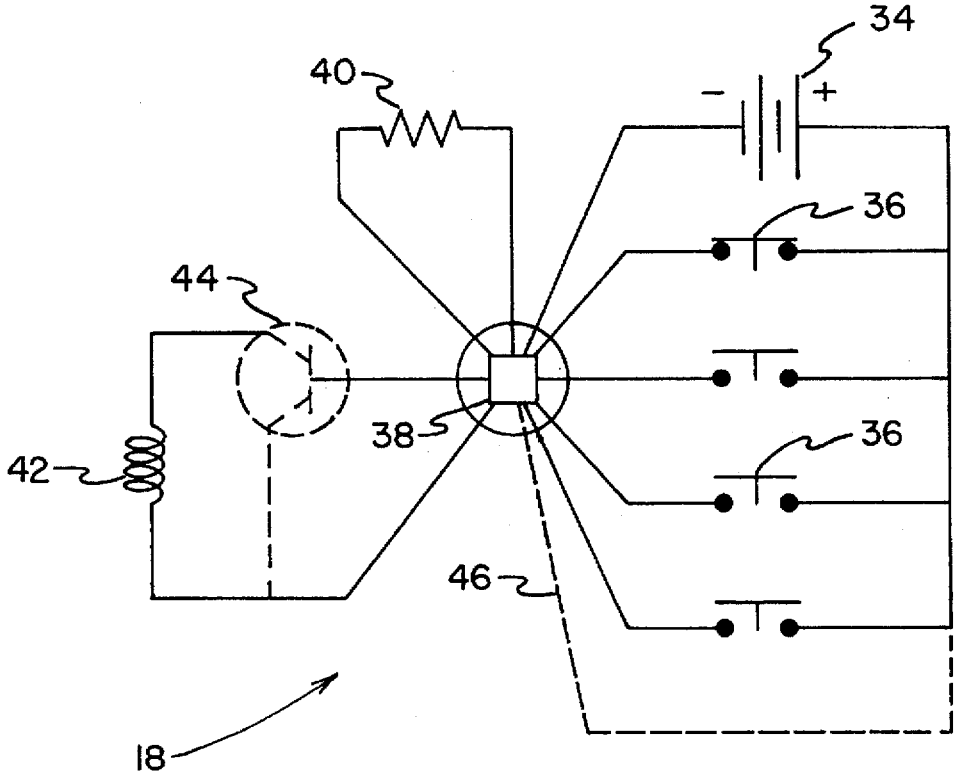
FIG. 7 is a diagrammatic electrical circuitry illustration of an electromagnetic signal generating means comprising a portion of the present invention.

As best illustrated in FIG. 7, it can be shown that the electromagnetic signal generating means 18 comprises a plurality of button switches 36 mounted along an exterior of the housing 26. Each of the button switches 36 communicates with the battery 34 to selectively energize a computer chip modulator 38 having a resistor 40 electrically connected thereto. A coil 42 is electrically coupled to the computer chip modulator 38, whereby an actuation of any one of the button switches will result in a modulated electrical current being passed through the coil 42 to create an electromagnetic field radiating therefrom. An optional transistor amplifier 44 can be interposed between the coil 42 and the computer chip modulator 38 to increase the current directed through the coil 42. An optional power lead 46 is utilized in combination with the optional transistor amplifier 44 to provide for an increased supply of electrical current from the battery 34 to the computer chip modulator 38. The computer chip modulator 38 is configured such that each of the button switches 36 can be operated to create differing wave forms and frequencies of current directed through the coil 42 to result in various electromagnetic signals being generated by the coil, as desired. The electromagnetic signals generated by the coil 42 can be received by the pickup 20 of the electric guitar to effect generation of an electrical signal which is subsequently amplified by unillustrated but conventionally known amplification means utilized within the electric guitar.

In use, the guitar pickup signal generator 10 according to the present invention can be utilized to generate a plurality of differing electromagnetic fields for reception by the pickup 20 of an electric guitar. The computer chip modulator 38 can be operated through a selective actuation of any one of the button switches 36, or a combinational depressing of the button switches to effect the generation of a current of a particular wave form and frequency directed through the coil 42 to generate such variety of electromagnetic signals. Further, because the mounting means 12 facilitates coupling of a pick 14 to the housing 26 thereof, simultaneous use of the device 10 and the pick 14 can be accomplished to create a variety of sounds through the guitar pickup. Further, because the strength of the electromagnetic field generated by the coil 42 varies in relation to a distance of the coil 42 from the receiving device, i.e. the pickup 20 of the electric guitar, the signal generator 10 can be selectively moved relative to the pickup 20 to control a gain of the electromagnetic signal received by the pickup 20.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A guitar pickup signal generator comprising:

an electromagnetic signal generating means mounted on a mounting means for securing a guitar pick; said mounting means, electromagnetic signal generating means, and pick being movable with respect to an electromagnetic pickup of an electric guitar;

said electromagnetic signal generating means generating an electromagnetic signal to create an electromagnetic field about said electromagnetic signal generating means, said signal generating means including a user-adjustable modulator for varying the modulation of the electromagnetic signal generated by said generating means in a manner adjustable by the user holding the mounting means;

wherein said electromagnetic signal is wirelessly transmitted to the electromagnetic pickup of an electric guitar when the electromagnetic field about said electromagnetic signal generating means is proximate the electromagnetic pickup such that movement of said signal generating means with respect to the electromagnetic pickup varies the electromagnetic signal transmitted from said generating means to said pickup; and wherein the electromagnetic signal generating means generates said electromagnetic signal independently of any electromagnetic signal generated by the electromagnetic pickup of the electric guitar.

2. The guitar pickup signal generator of claim 1, wherein the mounting means comprises a first housing portion shaped so as to define a first arcuate contour characterized by a first radius of curvature and a second arcuate contour characterized as having a second radius of curvature, wherein the first radius of curvature of the first arcuate contour is substantially greater than the second radius of curvature of the second arcuate contour;

a second housing portion shaped so as to define a third arcuate contour characterized by a third radius of curvature and a fourth arcuate contour characterized as having a fourth radius of curvature, wherein the third radius of curvature of the third arcuate contour is substantially greater than the fourth radius of curvature of the fourth arcuate contour defining a pick recess between the second contour and the fourth contour within which a portion of the pick can be positioned for securement thereto; and the second housing portion being cooperatively constructed relative to the first housing portion and secured to the first housing portion in a manner such that the arcuate contours of the first and second housing portions form a pick recess in which a pick may be securely retained between the housing portions, the first and second housing portions defining a housing having an interior compartment operable to contain the electromagnetic signal generating means within an interior compartment.

3. The guitar pickup signal generator of claim 2, wherein the electromagnetic signal generating means is located in the housing, wherein said user-adjustable modulator of said signal generating means comprises a plurality of button switches mounted along an exterior of the housing, and a computer chip modulator in electrical communication with the switches; and wherein said signal generating means further comprises a coil electrically coupled to the computer chip modulator and a battery in electrical communication with each of the button switches, whereby an actuation of any one of the button switches will result in a modulated electrical current being passed through the coil to create an electromagnetic field radiating therefrom.

4. The guitar pickup signal generator of claim 3, wherein the electromagnetic signal generating means located in the housing further comprises a transistor amplifier interposed between the coil and the computer chip modulator to increase the current directed through the coil.

5. The guitar pickup signal generator of claim 1, wherein the mounting means comprises a housing securable to a pick and adapted to be held in a hand grasping the pick, and wherein the electromagnetic signal generating means is located in the housing, wherein said user-adjustable modulator of said signal generating means comprises a plurality of button switches mounted along an exterior of the housing, and a computer chip modulator in electrical communication with the switches; and wherein said signal generating means further comprises a coil electrically coupled to the computer chip modulator and a battery in electrical communication with each of the button switches, whereby an actuation of any one of the button switches will result in a modulated electrical current being passed through the coil to create an electromagnetic field radiating therefrom.

6. The guitar pickup signal generator of claim 5, wherein the electromagnetic signal generating means located in the housing further comprises a transistor amplifier interposed between the coil and the computer chip modulator to increase the current directed through the coil.

7. The guitar pickup signal generator of claim 6, wherein the housing comprises a first housing portion; a second housing portion cooperatively constructed relative to the first housing portion and secured to the first housing portion, wherein the first and second housing portions form a pick recess therebetween within which a portion of the pick can be positioned for securement thereto.

* * * * *